US008201780B2

(12) United States Patent
Naujoks

(10) Patent No.: US 8,201,780 B2
(45) Date of Patent: Jun. 19, 2012

(54) GARBAGE BAG HOLDER

(76) Inventor: Richard Naujoks, Winnipeg (CA)

( * ) Notice: Subject to any disclaimer, the term of this patent is extended or adjusted under 35 U.S.C. 154(b) by 1 day.

(21) Appl. No.: 12/788,011

(22) Filed: May 26, 2010

(65) Prior Publication Data

US 2010/0310197 A1 Dec. 9, 2010

Related U.S. Application Data

(60) Provisional application No. 61/184,507, filed on Jun. 5, 2009.

(51) Int. Cl.
*B65B 67/04* (2006.01)

(52) U.S. Cl. ..... 248/99; 248/100; 248/175

(58) Field of Classification Search ..... 248/99–100, 248/95

See application file for complete search history.

(56) References Cited

U.S. PATENT DOCUMENTS 957,652 A * 5/1910 Bush ..... 248/97
1,653,393 A 12/1927 Cox
3,905,406 A 9/1975 Cruse
4,921,195 A * 5/1990 Clark et al. ..... 248/97
4,930,906 A * 6/1990 Hemphill ..... 383/89
5,213,291 A 5/1993 Wiebe
5,799,908 A * 9/1998 Downs ..... 248/97
6,325,341 B1 * 12/2001 Brown ..... 248/99
7,066,220 B1 6/2006 Take et al.

* cited by examiner

*Primary Examiner* — Amy J Sterling
(74) *Attorney, Agent, or Firm* — Ryan W. Dupuis; Kyle R. Satterthwaite; Ade & Company Inc.

(57) ABSTRACT

A garbage bag holder includes a base frame and a pair of side frames extending upwardly at spaced apart positions from the base frame to receive a paper bag or a plastic bag between the side frames. Depending frames are suspended from the top ends of the two side frames so as to be arranged to extend downwardly only partway into a paper bag so that the particular size of the frame is not required to be critically matched to the bags being used nor does the frame become soiled by the contents of the bag. Outward biasing force can be applied to the depending frames by the side frames along the full height of the depending frames to prevent any tearing at the top edges of a paper bag. Alternatively, a plastic bag can be held under tension between the top ends of the side frames.

14 Claims, 3 Drawing Sheets

GARBAGE BAG HOLDER

This application claims the benefit under 35 U.S.C. 119(e) of U.S. provisional application Ser. No. 61/184,507, filed Jun. 5, 2010.

FIELD OF THE INVENTION

The present invention relates to a holder for supporting a garbage bag thereon in an open position in which a pair of spaced apart depending frames are arranged to be received through an open top end of a garbage bag, for example a paper bag to hold the bag open under tension.

BACKGROUND

Various forms of garbage and waste, for example household waste including various compostable materials such as yard trimmings and the like, are commonly disposed of in flexible garbage bags. In order to maintain flexible garbage bags in an open position for depositing waste therein various types of holders are known to support garbage bags thereon.

U.S. Pat. No. 5,213,291 by Wiebe disclosed one example of a garbage bag holder in which a plastic garbage bag is arranged to be retained in an open position under tension between two opposed side frames having angularly outward offset portions at the top ends thereof to retain a top edge of the bag folded overtop of the offset portions and thus suspend the plastic garbage bag therefrom. Various similar design are disclose in the prior art, however such designs cannot be adapted for paper bags as the top edge of a paper bag cannot be readily folded over without tearing the bag so that these types of garbage bag holders cannot accommodate paper bags.

When using paper bags which typically are more rectangular in shape, various other designs of bag holders are disclosed in the prior art. Typical examples can be found in U.S. Pat. No. 1,653,393 by Cox; U.S. Pat. No. 3,905,406 by Cruse; and U.S. Pat. No. 7,066,220 by Take et al. In each instance two side frames, each comprising two parallel and spaced apart downward extending legs, are mounted on a common frame spaced apart from one another for receiving the four legs downwardly into the four corners of a generally rectangular paper bag. The legs are inserted into the bag along the full height of the bag to support the legs on the bottom of the bag while the upper portion of the legs maintain the top end of the bag in an open configuration. In the illustrated examples in the prior art noted herein, the size of the frames is critical as it must closely match the size of the bag to receive the four legs within the four corners of the bag. Accordingly the frames are not adaptable to minor variations in sizes of the bags. Furthermore the legs span the full height of the bag within the interior thereof which is filled with waste such that the legs become soiled and contaminated with waste and require cleaning after use. Due to the freely unsupported bottom ends of the legs, it is difficult to provide an outward pressure along the length of the bag so that even if the side frames are provided with some mechanism to spread the frame, any outward pressure to support the bag under tension concentrates the outward separation force between the two side frames at the pivotal connection between the two side frames at the top end of the bag which promotes tearing of the top edge of the bag.

SUMMARY OF THE INVENTION

According to one aspect of the invention there is provided a garbage bag holder arranged for holding a garbage bag, the holder comprising:

a base frame arranged to support a bottom end of the garbage bag thereabove;

a pair of side frames extending upwardly at spaced apart positions from opposing ends of the base frame from a bottom end mounted on the base frame to a top end spaced upwardly from the base frame;

a depending frame arranged to be mounted on each side frame adjacent the top end thereof in a working position in which the depending frame depends downwardly from a top end mounted on the respective side frame to a bottom end which is freely suspended below the top end of the respective side frame so as to be arranged to be received downwardly into an open top end of the garbage bag;

a biasing mechanism arranged to bias the side frames and the depending frames supported thereon in the working position laterally outwardly and away from one another.

As described herein, a bag holder accommodates paper bags by providing an external frame which supports the bag thereon instead of being received within the bag so that the particular size of the frame is not required to be critically matched to the bags being used nor does the frame become soiled by the contents of the bag as occurs in the prior art configurations for holding paper bags in an open configuration. The depending frames which are suspended from the top ends of the two side frames according to the bag holder of the present invention are permitted to extend downwardly only partway into the bag so that even the depending frames can largely avoid being soiled by the contents of the garbage bag. By further biasing the two side frames outwardly from one another, and supporting the depending frames to extend downwardly from the top ends of the side frames in the working position, the outward biasing force can be applied along the full length of the depending frames between top and bottom ends thereof instead of concentrating the outward force near the top of the bag so that the holder according to the present invention is therefore much less likely to cause any tearing at the top edges of the bag. By further providing a hinge to support the depending frames on the side frames with a retainer which selectively retains the depending frames in the working position, the dependent frames can quickly and easily be inserted into a paper bag without awkward manipulation of the bag and without any awkward fasteners or tools being required to mount the depending frames in the working position.

The biasing mechanism is preferably arranged to bias bottom ends of the depending frames in the working position away from one another.

The biasing mechanism may be arranged to bias the depending frames outwardly away from one another along a full height thereof in the working position.

When provided in combination with a paper bag supported thereon, the side frames preferably have a height extending upwardly from the base frame corresponding approximately to the height of the paper bag.

The depending frames are preferably arranged to extend downwardly only partway into the paper bag supported at the bottom end thereof on the base frame in the working position of the depending frames.

Preferably the paper bag is arranged to be received between the two side frames.

Each side frame preferably comprises a generally U-shaped frame member comprising two upright leg portions arranged to receive the bag therebetween and a connecting portion connected between the two upright leg portions.

The biasing mechanism may comprise a portion of the side frames arranged to be flexed inwardly such that the top ends of the side frames are closer to one another in the working position.

Each depending frame may be supported on the top end of the respective side frame for pivotal movement upwardly and inwardly towards the other depending frame to a released position above the side frames.

Each side frame preferably comprises a pair of spaced apart upright leg portions and a connecting portion connected between the top ends of the leg portions at a location spaced laterally outwardly from a plane of the upright leg portions in which the depending frames are pivotally mounted on the connecting portions of the respective side frames.

There may be provided a retainer portion formed on each depending frame which is arranged to selectively prevent pivotal movement of the depending frames inwardly towards one another from the working positions thereof.

Each side frame may comprise a pair of spaced apart upright leg portions and a connecting portion connected between the two leg portions at a location spaced laterally outwardly from a plane of the leg portions by a pair of offset portions connecting opposing ends of the connecting portion to the respective leg portions. In this instance, the retainer of each depending frame is preferably arranged for selective engagement with respective ones of the offset portions in the working position.

Each depending frame may comprise two side portions extending radially outward from the respective longitudinal axis to a connecting portion connected between the two side portions. In this instance, the retainer portions on each depending frame preferably project outwardly away from one another at respective inner ends of the side portions.

The retainer portions are preferably arranged to be flexed inwardly towards one another from an engaged position in engagement with the respective offset portions of the side frames and a disengaged position in disengagement with the respective offset portions in the working position of the depending frames.

When the two side portions of each depending frame are pivotally supported on the connecting portion of the respective side frame by respective hinge portions, preferably the hinge portions are slidable along the connecting portion of the respective side frames between an engaged position in which the retainer portions are engaged with the respective offset portions of the side frames and a disengaged position in which the retainer portions are disengaged with the respective offset portions.

According to a further aspect of the present invention there is provided a garbage bag holder arranged for holding a garbage bag, the holder comprising:

a base frame spanning in a lateral direction between two opposed ends and being arranged to support a bottom end of the garbage bag thereabove;

a pair of side frames extending upwardly at spaced apart positions from opposing ends of the base frame, each side frame comprising a generally U-shape frame member which comprises:

two upright leg portions mounted at respective bottom ends on the base frame;

two offset portions mounted on the upright leg portions respectively to extend outwardly in the lateral direction of the base frame from respective inner ends on the respective upright leg portions to respective outer ends; and a connecting portion spanning between the outer ends of the two offset portions of the respective side frame such that the connecting portions of the two side frames are generally parallel to one another and spaced apart from one another in the lateral direction of the base frame; and a pair of depending frame mounted on the connecting portions of the side frames respectively, each depending frame comprising a generally U-shape frame member which comprises:

two side portions pivotally mounted at respective inner ends at spaced apart positions on the connecting portion of the respective side frame such that the depending frame is arranged for pivotal movement about a longitudinal axis of the connecting portion of the respective side frame between a working position in which the depending frame depends downwardly from the inner ends mounted on the connecting portion of the respective side frame to an outer end which is freely suspended below the top end of the respective side frame so as to be arranged to be received downwardly into an open top end of the garbage bag and a released position in which the two side portions extend generally upward from the connecting portion of the respective side frames;

a connecting portion joined between the two side portions at a position spaced outwardly from the respective longitudinal axis; and a pair of retainer portions formed on the two side portions adjacent the inner ends thereof in which the retainer portions extend outwardly away from one another so as to be arranged to be engaged below the two offset portions and selectively retain the depending frames in the working position, the retainer portions being arranged to be inwardly flexed towards one another to release engagement of the retainer portions with the two offset portions such that the depending frames are arranged to be selectively pivotal inwardly towards one another from the working position towards the released position when the retainer portions are released;

the side frames being arranged to be flexed relative to the base frame inwardly towards one another adjacent the top ends thereof when the depending frames are arranged to be received downwardly through the open top end of the garbage bag so as to be arranged to bias the side frames and the depending frames supported thereon in the working position laterally outwardly and away from one another in the working position.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
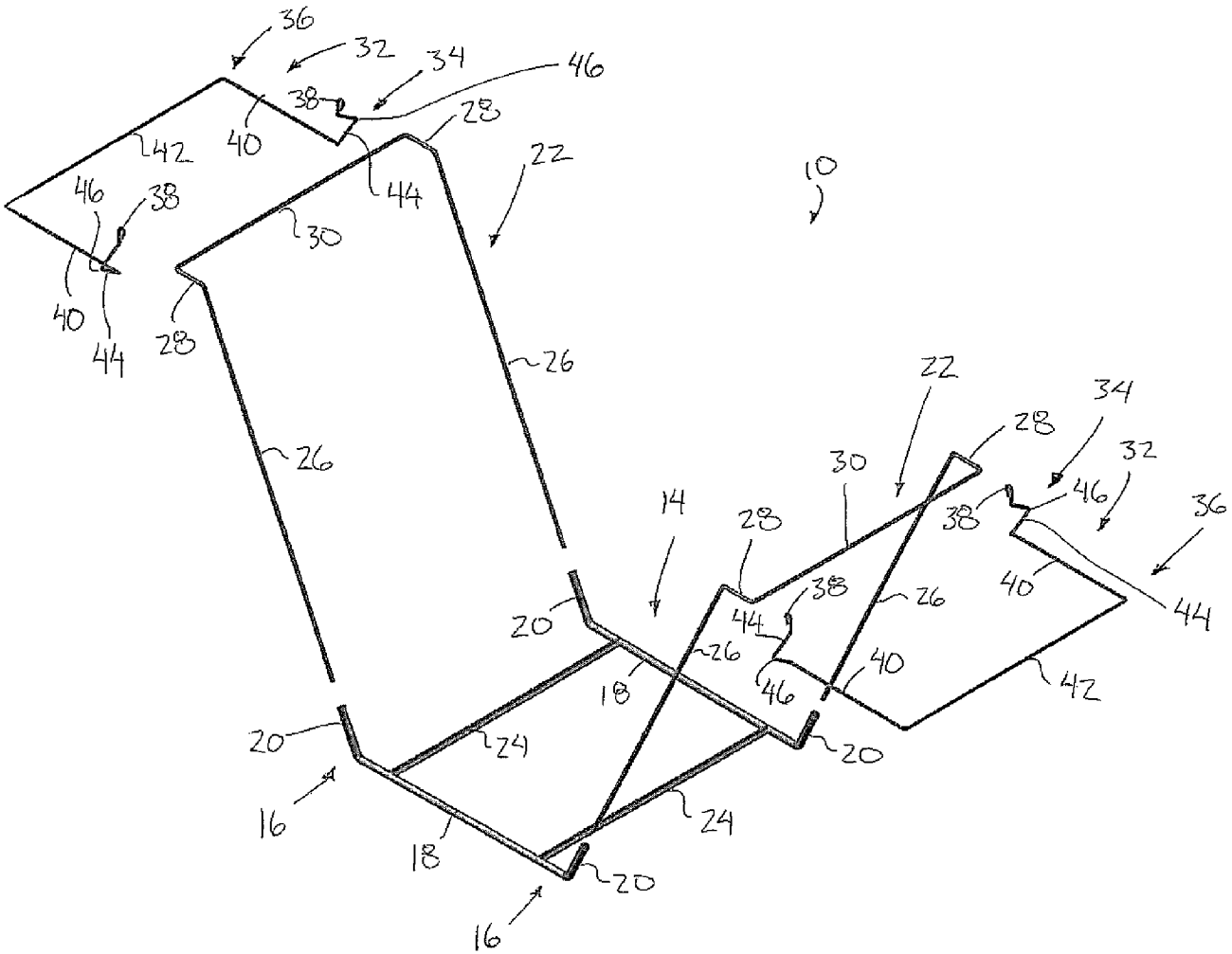
FIG. 1 is an exploded perspective view of the bag holder.
Figure 2:
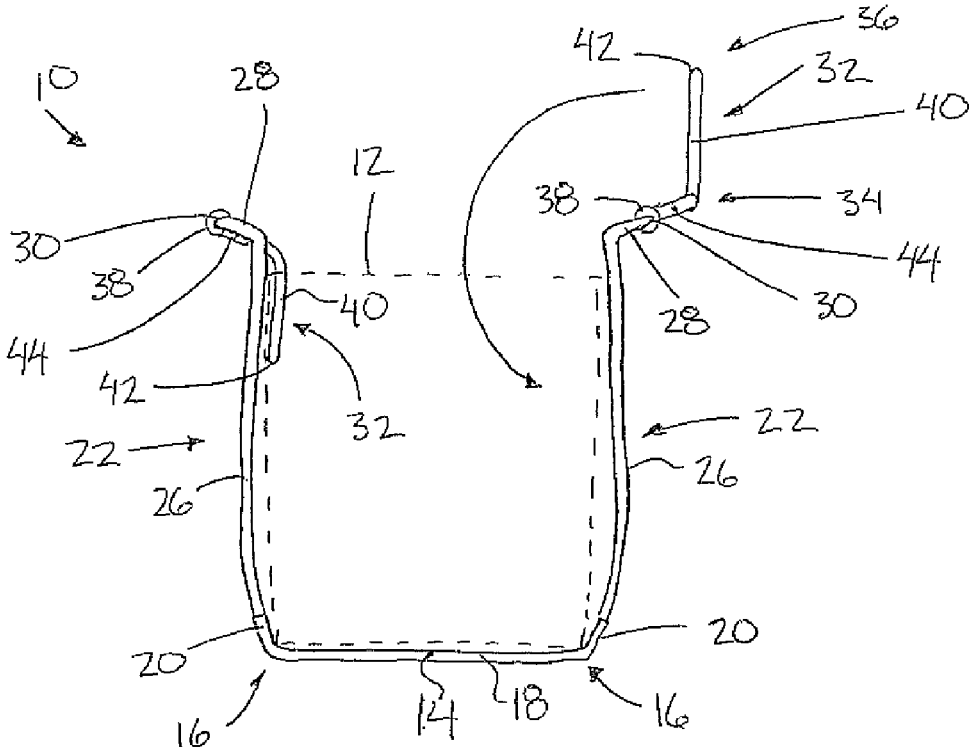
FIG. 2 is a side elevational view of the bag holder in which one of the depending frames is in the working position and one of the depending frames is in the released position.
Figure 3:
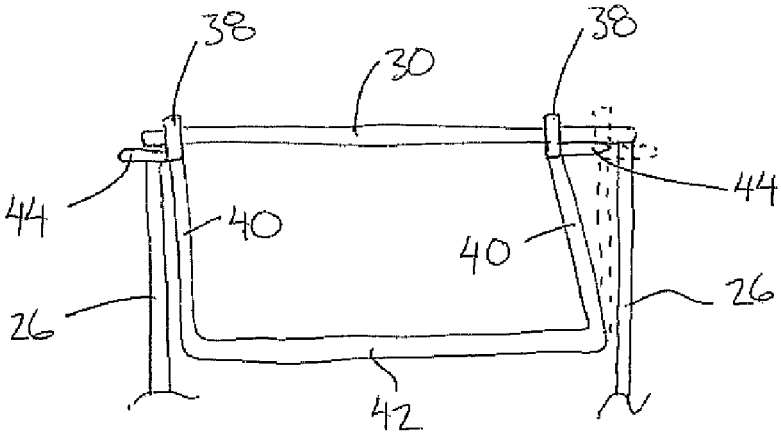
FIG. 3 is an end elevational view of one of the depending frames in the working position in which one of the retainers is engaged and one of the retainers is flexed into a released configuration.
Figure 4:
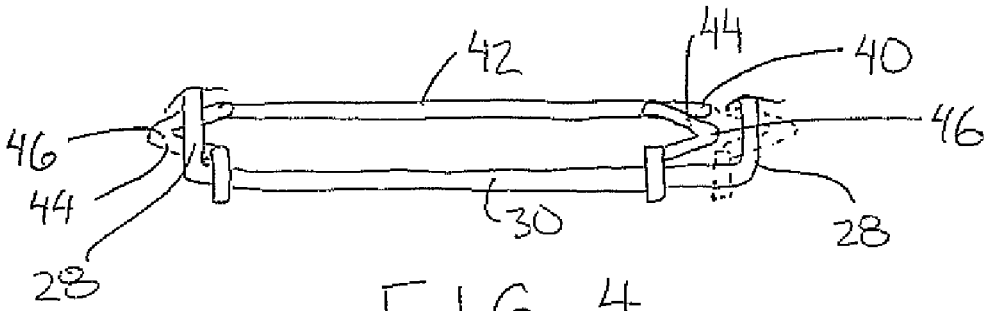
FIG. 4 is a top plan view of the depending frame according to FIG. 3 in the working position in which one of the retainers is flexed into a disengaged configuration.
Figure 5:
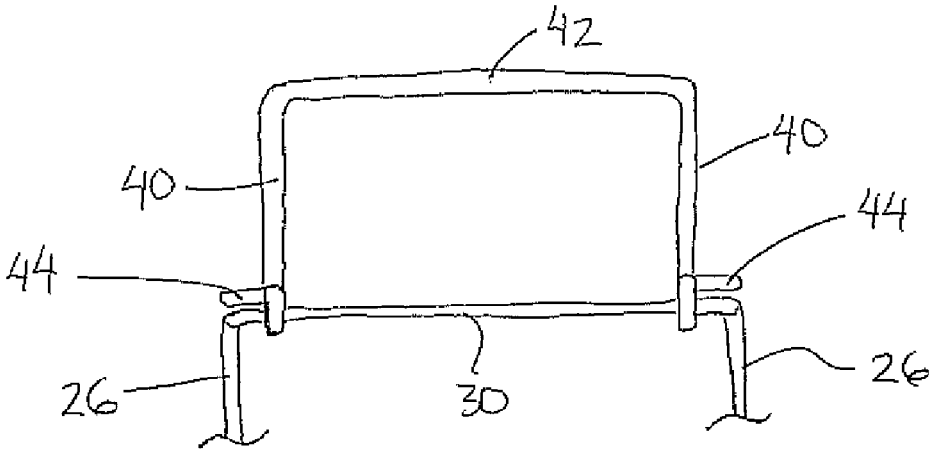
FIG. 5 is an end elevational view of one of the depending frames in the released position.
Figure 6:
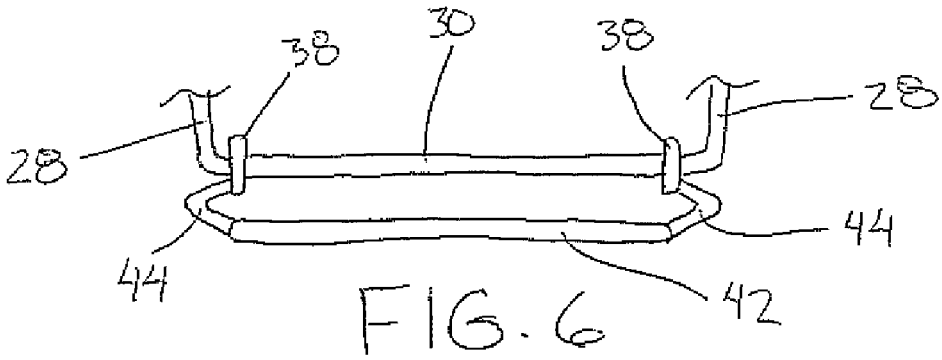
FIG. 6 is a top plan view of the depending frame according to FIG. 5 in the released position.

Referring to the accompanying figures there is illustrated a garbage bag holder generally indicated by reference numeral 10. The holder 10 is well suited for supporting either plastic or paper garbage bags thereon such that the bag is held open under tension by the holder 10 regardless of the type of bag supported thereon. The types of bags arranged to be supported on the holder can generally comprise any type of bag commonly referred to as a garbage bag and the like such as bags for receiving various forms of household and yard waste therein including compostable materials and the like. The holder 10 is particularly well suited for supporting large paper bags thereon of the type intended for yard waste and other compostable materials. Paper bags 12 of this type generally comprise a rectangular bottom wall with four rectangular side walls extending upwardly therefrom to an open top end of the bag.

The holder 10 includes a base frame 14 arranged to be supported on a generally horizontal supporting surface to span in a lateral direction between two opposed ends. The base frame 14 comprises two rails 18 spanning in the lateral direction parallel and spaced apart from one another along opposing sides of the base frame between sockets 20 formed at the opposing ends thereof. The rails 18 comprise rod members, and the sockets 20 comprise tubular formations which are formed by respective bores in the ends of the rod members defining the rails. The tubular formations defining the sockets 20 extend upwardly and laterally outwardly at an upward inclination for supporting a pair of side frames 22 extending upwardly from opposing ends of the base frame. The base frame 14 further comprises two crossbars 24 adjacent the opposing ends which are connected between the two rails parallel and spaced apart from one another and connected to the rails in fixed perpendicular orientation in relation thereto.

The two side frames 22 are mounted within the respective sockets 20 to extend upwardly and outwardly in the lateral direction at spaced apart positions from the opposing ends of the base member so as to generally receive the garbage bag therebetween when the garbage bag is supported at a bottom end on top of the base frame 14. Each side frame 22 comprises a single continuous rod of bent metal forming a generally U-shaped frame member.

The frame member of each side frame 22 comprises two upright leg portions 26 mounted at respective bottom ends on the base frame by insertion of the bottom ends into respective ones of the sockets 20 such that the upright leg portions extend at the upward and laterally outward incline of the sockets when the side frames are in a relaxed and unflexed condition. The leg portions 26 are all substantially identical in length having a height between top and bottom ends when the leg portions are flexed into a generally vertical orientation which corresponds approximately to the height of the garbage bag supported at a bottom end on top of the base frame 14.

The frame member of each side frame 22 further comprises two offset portions 28 mounted on the two upright leg portions of the respective side frame such that each offset portion 28 extends outwardly in the lateral direction of the base frame from an inner end mounted on the respective upright leg portion to a respective outer end away from the opposing side frame. The two offset portions 28 within each side frame are generally parallel with one another and extend at an upward and outward inclination when the upright leg portions are flexed into a generally vertical orientation.

The frame member of each side frame 22 further comprises a connecting portion 30 which is connected between the outer ends of the two offset portions of the respective side frame. The offset portions are all identical in length such that the connection portions of each side frame are resultingly parallel and spaced apart from one another in the lateral direction of the base frame so as to be spaced laterally outward and offset from a plane containing the two upright leg portions 26 of the respective side frame.

The holder 10 further comprises a pair of depending frames 32 mounted on respective ones of the two side frames 22 at the top end thereof such that each depending frame depends downwardly in a working position from an inner end 34 supported on the top end of the respective side frame to an outer end 36 which is substantially freely unsupported spaced below the connecting portion at the top end of the respective side frame. Each depending frame 32 also comprises a single continuous rod member of bent metal which is formed into a generally U-shaped frame member.

Each depending frame comprises two hinge portions 38 which are pivotally mounted onto the connecting portion of the respective side frame 22 at spaced apart positions thereon adjacent opposing ends of the connecting portion adjacent to the two offset portions 28. The two hinge portions 38 comprise opposing ends of the single continuous member forming the depending frame in which each end is bent into a loop wrapped about the connecting portion 30 of the respective side frame such that the hinge portions are pivotal about a longitudinal axis of the respective connecting portion while also being permitted to slide along the connecting portion in the direction of the longitudinal axis thereof.

Each depending frame 32 further comprises two side portions 40 mounted at the inner ends 34 thereof on the respective ones of the two hinge portions 38 to extend radially outward from the longitudinal axis of the connecting portion of the respective side frame towards the outer end 36.

Each depending frame further comprises a connecting portion 42 which is connected between the outer ends of the two side portions 40 so as to be substantially parallel to the respective longitudinal axis and in perpendicular connection to the two side portions at a location spaced radially outwardly from the longitudinal axis. Within each depending frame 32, the connecting portion connects the two side portions and the two hinge portions together such that the entire depending frame is pivotal together from the working position to a released position.

In the working position the side portions 40 of the depending frames extend downwardly from the inner end to the outer ends thereof such that the connecting portions of the depending frames are parallel and spaced below the respective connecting portions of the side frames so that the depending frames are arranged to be received downwardly into the open top end of the garbage bag supported on the base frame. In the released position the depending frames are pivoted inwardly towards one another and upwardly in relation to the working position such that the depending frames are removed from the garbage bag and the open top end of the garbage bag is substantially unobstructed so that the garbage bag can be removed upwardly and away from the bag holder for separation therefrom.

Each depending frame further comprises two retainer portions which are connected between the two hinge portions and the respective inner ends of the two side portions supported thereon. The retainer portions 44 are thus formed on the two side portions at the inner ends thereof in which each retainer portion is a generally V-shaped formation projecting outwardly away from the other retainer portion of the same depending frame toward the respective apex 46 of the protrusion defining the outermost portion of the retainer portion.

As the retainer portions project outwardly away from one another from the respective hinge portions 38 at opposing ends of the connecting portions 42, the retainer portions 44 are arranged to overlap the respective offset portions 28 of the side frames. The retainer portions are positioned inwardly in relation to the respective longitudinal pivot axes of the depending frames towards the opposing side frame when the depending frames are oriented in the working position to extend generally downwardly from the inner end to the outer end thereof. Furthermore in the working position the retainer portions 44 are arranged to be engaged directly below the respective offset portions 28 such that inward pivotal movement of the depending frames towards the released position from the working position is effectively prevented by engagement of the retainer portions below the respective offset portions 28 at the inner sides of the longitudinal pivot axes of the depending frames.

The side portions and the retainer portions of the depending frames are arranged to be sufficiently flexible that the two retainer portions of each depending frame are arranged to be flexed inwardly towards one another by sliding movement of the respective hinge portions 38 in the axial direction along the connecting portion 30 of the respective side frames 22 until the retainer portions 44 no longer overlap the two offset portions 38 in the horizontal direction of the longitudinal axis and so that the retainer portions are effectively released from an engaged position to a disengaged position. In the disengaged position, the retainer portions no longer prevent inward pivotal movement of the depending frames towards one another such that the depending frames can be pivoted inwardly and upwardly towards the released positions respectively.

In the working position in which the depending frames extend downwardly into open top end of the bag supported on the base frame, the side frames 22 must be flexed inwardly towards one another into a flexed position relative to the base frame so that the spaced apart top ends of the side frames 22 are brought closer together to correspond to the width of the bag supported on the holder and so that both depending frames can be pivoted from the released position into the working position thereof.

To pivot the depending frames into the working position, the retainer portions 40 of each depending frame 32 are again flexed inwardly towards one another into a disengaged position so that the retainer portions can be rotated past the respective offset portions 28 of the side frames to again locate the retainer portions below the offset portions 28 such that releasing the retainer portions back into the engaged position prevents pivoting of the depending frames back into the released position.

The flexing of the side frames functions as a biasing mechanism which provides an outward biasing force to the two side portions and the depending frames held in fixed relation thereto by the retainer portions so that the full height of the retainer portions between the top and bottom ends thereof are urged outwardly along a broad surface area of the bags to hold the open top end of the bags under tension between the two side frames.

The two side frames are typically spaced apart from one another by a width corresponding approximately to the width of the bag received therebetween while the two upright leg members within each side frame are also spaced apart by a corresponding horizontal width of the bags therebetween so that the bags are received between the two upright leg portions of each side frame. By arranging the overall length of the upright leg members when received within the respective sockets of the base frame to be approximately equal to the height of the bag supported on the top of the base frame, the depending frames are suitably aligned at the open top end of the bag for being received therein.

When the bags comprise a recommended fill line at a location towards the top end thereof but spaced below the open top end, the length of the side portions of the depending frames typically correspond approximately to the height of the bags between the fill line and the open top end thereof such that the connecting portions of the depending frames in their lowermost working position remain substantially at or above the recommended fill line of the bags. Accordingly when the bag is filled to its maximum recommended fill height, the entirety of the depending frames remains above the waste material in the bag so that the depending frames are less likely to become soiled by the contents of the bag, nor will the contents of the bag interfere with pivoting of the depending frames from the working position to the released position thereof.

Due to the angularly and laterally outward offsets of the connecting portions 30 of the two side frames, the holder 10 is also well suited to holding flexible plastic bags thereon in addition to supporting paper bags thereon. When used with plastic bags, the top edge of the plastic bags are folded outwardly and downwardly overtop of the two opposed connecting portions 30 of the two side frames 22 such that the top end of the bag is again held under tension between the two side frames which are flexed inwardly towards one another to a suitable spacing which corresponds to the appropriate dimensions of the bag being retained thereon.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A garbage bag holder arranged for holding a garbage bag, the holder comprising:

a base frame arranged to support a bottom end of the garbage bag thereabove;

a pair of side frames extending upwardly at spaced apart positions from opposing ends of the base frame from a bottom end mounted on the base frame to a top end spaced upwardly from the base frame;

a depending frame arranged to be mounted on each side frame adjacent the top end thereof in which the depending frame depends downwardly from a top end mounted on the respective side frame to a bottom end which is suspended in a working position below the top end of the respective side frame so as to be arranged to be received downwardly into an open top end of the garbage bag;

each depending frame being supported on the top end of the respective side frame for pivotal movement upwardly and inwardly towards the other depending frame from the working position to a released position above the side frames;

a biasing mechanism arranged to bias the side frames and the depending frames supported thereon in the working position laterally outwardly and away from one another; and a retainer portion formed on each depending frame which is arranged to selectively prevent pivotal movement of the depending frames inwardly towards one another from the respective working positions towards the respective released positions thereof.

2. The holder according to claim 1 wherein the biasing mechanism is arranged to bias bottom ends of the depending frames in the working position away from one another.

3. The holder according to claim 1 wherein the biasing mechanism is arranged to bias the depending frames outwardly away from one another along a full height thereof in the working position.

4. The holder according to claim 1 in combination with a paper bag supported thereon, the side frames having a height extending upwardly from the base frame corresponding approximately to the height of the paper bag.

5. The holder according to claim 4 wherein the depending frames are arranged to extend downwardly only partway into the bag supported at the bottom end thereof on the base frame in the working position of the depending frames.

6. The holder according to claim 4 wherein the bag is arranged to be received between the two side frames.

7. The holder according to claim 4 wherein each side frame comprises a generally U-shaped frame member comprising two upright leg portions arranged to receive the bag therebetween and a connecting portion connected between the two upright leg portions.

8. The holder according to claim 1 wherein the biasing mechanism comprises a portion of the side frames arranged to be flexed inwardly such that the top ends of the side frames are closer to one another in the working position.

9. The holder according to claim 1 wherein each side frame comprises a pair of spaced apart upright leg portions and a connecting portion connected between the top ends of the leg portions at a location spaced laterally outwardly from a plane of the upright leg portions, the depending frames being pivotally mounted on the connecting portions of the respective side frames.

10. The holder according to claim 1 wherein each side frame comprises a pair of spaced apart upright leg portions and a connecting portion connected between the two leg portions at a location spaced laterally outwardly from a plane of the leg portions by a pair of offset portions connecting opposing ends of the connecting portion to the respective leg portions, the retainer of each depending frame being arranged for selective engagement with respective ones of the offset portions in the working position.

11. The holder according to claim 10 wherein each depending frame comprises two side portions extending radially outward from the respective longitudinal axis to a connecting portion connected between the two side portions, the retainer portions on each depending frame projecting outwardly away from one another at respective inner ends of the side portions.

12. The holder according to claim 11 wherein the retainer portions are arranged to be flexed inwardly towards one another from an engaged position in engagement with the respective offset portions of the side frames and a disengaged position in disengagement with the respective offset portions in the working position of the depending frames.

13. The holder according to claim 11 wherein the two side portions of each depending frame are pivotally supported on the connecting portion of the respective side frame by respective hinge portions, the hinge portions being slidable along the connecting portion of the respective side frames between an engaged position in which the retainer portions are engaged with the respective offset portions of the side frames and a disengaged position in which the retainer portions are disengaged with the respective offset portions.

14. A garbage bag holder arranged for holding a garbage bag, the holder comprising:

a base frame spanning in a lateral direction between two opposed ends and being arranged to support a bottom end of the garbage bag thereabove;

a pair of side frames extending upwardly at spaced apart positions from opposing ends of the base frame, each side frame comprising a generally U-shape frame member which comprises:

two upright leg portions mounted at respective bottom ends on the base frame;

two offset portions mounted on the upright leg portions respectively to extend outwardly in the lateral direction of the base frame from respective inner ends on the respective upright leg portions to respective outer ends; and a connecting portion spanning between the outer ends of the two offset portions of the respective side frame such that the connecting portions of the two side frames are generally parallel to one another and spaced apart from one another in the lateral direction of the base frame; and a pair of depending frame mounted on the connecting portions of the side frames respectively, each depending frame comprising a generally U-shape frame member which comprises:

two side portions pivotally mounted at respective inner ends at spaced apart positions on the connecting portion of the respective side frame such that the depending frame is arranged for pivotal movement about a longitudinal axis of the connecting portion of the respective side frame between a working position in which the depending frame depends downwardly from the inner ends mounted on the connecting portion of the respective side frame to an outer end which is suspended below the top end of the respective side frame so as to be arranged to be received downwardly into an open top end of the garbage bag and a released position in which the two side portions extend generally upward from the connecting portion of the respective side frames;

a connecting portion joined between the two side portions at a position spaced outwardly from the respective longitudinal axis; and a pair of retainer portions formed on the two side portions adjacent the inner ends thereof in which the retainer portions extend outwardly away from one another so as to be arranged to be engaged below the two offset portions and selectively retain the depending frames in the working position, the retainer portions being arranged to be inwardly flexed towards one another to release engagement of the retainer portions with the two offset portions such that the depending frames are arranged to be selectively pivotal inwardly towards one another from the working position towards the released position when the retainer portions are released;

the side frames being arranged to be flexed relative to the base frame inwardly towards one another adjacent the top ends thereof when the depending frames are arranged to be received downwardly through the open top end of the garbage bag so as to be arranged to bias the side frames and the depending frames supported thereon in the working position laterally outwardly and away from one another.

* * * * *